United States Patent [19]

Hinze et al.

[11] 4,324,955

[45] Apr. 13, 1982

[54] PUSHBUTTON SWITCH ARRANGEMENT

[75] Inventors: Klaus Hinze, Berlin; Klaus B. Wisskirchen, Eppstein, both of Fed. Rep. of Germany

[73] Assignee: ITT Industries, Inc., New York, N.Y.

[21] Appl. No.: 165,614

[22] Filed: Jul. 3, 1980

[30] Foreign Application Priority Data

Jul. 14, 1979 [DE] Fed. Rep. of Germany ..... 2928559

[51] Int. Cl.[3] ..... H01H 9/20

[52] U.S. Cl. ..... 200/5 E

[58] Field of Search ..... 200/5 E, 5 EA, 5 EB, 200/5

[56] References Cited

U.S. PATENT DOCUMENTS 3,472,973 10/1969 Stout ..... 200/5 EA 3,736,809 6/1973 Crabaugh et al. ..... 200/5 EB X

*Primary Examiner*—James R. Scott

*Attorney, Agent, or Firm*—James B. Raden; William J. Michals

[57] ABSTRACT

The locking bar for mutually acting upon several push button switches, which is slideably arranged within an U-shaped fastening bar for the switches, which are arranged in parallel to each other, consists of a metal bar with punched holes, on which plastic locking elements can be snapped-on. A great variety of locking bars can be built up using only two simple piece parts.

3 Claims, 9 Drawing Figures

6
7
8
10
13
14
15
16
17
18
19
20
21

PUSHBUTTON SWITCH ARRANGEMENT

BACKGROUND OF THE INVENTION

The invention relates to a pushbutton switch arrangement in which the switches are mounted parallel in relation to one another on a U-shaped bar extending vertically in relation to the pushbutton switches, in which a locking bar cooperating with the switch slides and provided with cams, is arranged displaceably in the longitudinal direction.

For the switching of electrical equipment, such as radio and television receivers, mostly several pushbutton switches are required for the individual functions. These switches are mostly arranged parallel in relation to one another and mounted on a U-shaped bar extending vertically in relation to the switches, with this bar also being referred to as the chasis. Mostly it is still required that upon actuation of one pushbutton switch, another already depressed switch returns to normal, or that by one depressed pushbutton switch all other switches can be returned to their non-depressed positions. For this purpose it is known to arrange in the U-shaped hold bar a locking bar which is provided with individual cams for cooperating with the slides of the individual pushbutton switches. Upon actuation of one pushbutton switch, the bar is displaced in such a way by thecorresponding cam, that at least one further cam will release the slide of another pushbutton switch, so that the latter is permitted to return to normal. This is referred as the mutual release of pushbuttons. In practice, there are used several types of embodiments of such locking bars.

Locking bars of metal, such as of steel, are made by way of punching, and the engaging cams are bent out of the bar. Such bars are relatively exact in their dimensions, but must go through several steps of operation in the course of being manufactured. Thus, it is necessary to remove the burrs, and to restraighten the mostly bent parts. The length of such blocking bars is restricted owing to the tools used for the manufacture, so that in cases where longer locking bars are required, several such bars have to be connected to one another via a suitable coupling. Moreover, locking bars of metal have the disadvantage of having a relatively high weight and of being slow in functioning, because relatively great masses have to be accelerated during actuation.

Locking bars, therefore, have also already been made from plastics material. Here, too, the length of the individual bar is restricted by the employed tool, e.g., the injection moulding tool. Accordingly, in cases where long switch arrangements are required, several bars have to be coupled to one another also in this case. Locking bars of plastics material, of course, have a lower weight, so that weaker locking slide springs can be used, and are of easier action than locking bars of metal. Plastics materials, however, compared with metal, have a higher heat expansion coefficient, so that in the case of temperature variations, there also appear variations in length with respect to the U-shaped hold bar of metal, thus causing detrimental effects on the locking function of the bar. The proper functioning of the bar is affected in the case of many plastics materials by the relatively high absorption of moisture.

Accordingly, both kinds of locking bars have the disadvantage that they can only be manufactured in restricted lengths, and that in the cases where greater lengths are required, coupling elements have to be employed between the individual bars. Both kinds of locking bars, however, also have the disadvantage that different tools are required for bars having a different spacing between locking cams, thus resulting in a substantial increase in costs, affecting both manufacture and stockkeeping. In fact, in practice the distances between switches in the case of new types of equipment, are always again varied either for constructional or aesthetic reasons so that, although the same switches are used, there are always again required different locking bars with different spacings between cams.

It is the object of the invention to provide a locking bar which can practically be manufactured in any desired length, and with which the spacings between locking cams are variable at will from bar to bar.

SUMMARY OF THE INVENTION

According to the invention, this object is achieved by taking the measures set forth in the characterizing part of claim 1.

Advantageous embodiments of the invention are set forth in the subclaims.

The invention resides in that the locking bar is built up from a metal bar with locking segments of plastics material mounted thereon. Since the metal bar is of very simple construction, it can be manufactured at any optional length from a metal tape. Moreover, the metal bar offers the advantage that the locking bar has almost the same heat expansion coefficient as the U-shaped mounting bar, so that the locking function is not entailed by any difficulties in the event of temperature variations.

The locking segments are made of plastics material thus resulting in a small mass during acceleration and in a good capability of sliding in the U-shaped mounting bar, thus enabling an easy and low-noise running in the mounting bar. Both the metal bar and the locking segments are so designed that the locking segments can be practically mounted at any suitable point on the metal bar, so that by using these two basic components, locking bars with any desired spacing between cams can be manufactured.

Accordingly, the lock bar of the invention not only combines the advantages of the metal bars and of the plastics bars but, from two components which are simple and easy to manufacture, it is possible to produce bars of any desired length with any optional spacing between the cams by simply joining them together, thus not only doing away with the necessity of having to manufacture bars with a different cam spacing, but also dispensing with coupling members in cases where long pushbutton arrangements are required. The locking segments preferably have a length corresponding to the width of one switch, so that the locking bar according to the invention can also be employed for obtaining high-density switch arrangements.

Moreover, it is possible to use locking segments with different cam arrangements, so that at any suitable point of the locking bar, cams with an additional function, for example, for actuating an additional switch, e.g. a so-called muting switch, or else for alternately switching over two pushbutton switches arranged at any arbitrary points, can be inserted.

BRIEF DESCRIPTION OF THE DRAWING

The invention will now be described with reference to FIGS. 1 to 9 of the accompanying drawings, in which.

DETAILED DESCRIPTION

Figure 1:
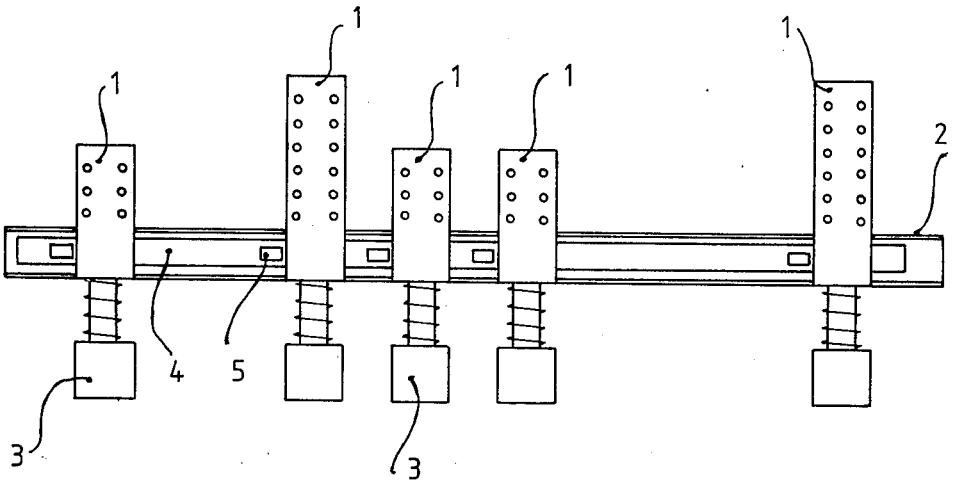
FIG. 1 shows a top view of a pushbutton switch arrangement to which the invention is applicable.

As is shown in FIG. 1, several pushbutton switches 1 are mounted in such a way to one common U-shaped bar 2, that the individual pushbutton switches come to lie parallel in relation to one another, and the mounting bar 2 extends vertically in relation to the pushbutton switches. FIG. 1 is still to show that pushbutton switches comprising various numbers of contacts and, accordingly, of different length, as well as with a different lateral spacing, can be assembled in this way. In the U-shaped hold bar 2, the locking bar 4 is arranged displaceably.

Figure 2:
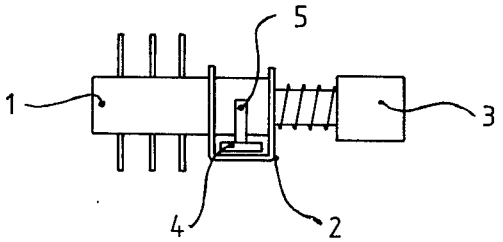
FIG. 2 shows a side view of the arrangement of FIG. 1, FIGS. 3 and 5 show two different types of embodiments of locking segments, perspectively as seen from below.

As can be seen from the side view of FIG. 2, the locking bar 4 is provided with suitable cams cooperating with the slides of the individual pushbutton switches. Upon actuating the pushbutton 3 of one pushbutton switch, the slide of the switch exerts a pressure upon the cam 5 of the locking bar 4, thus effecting a longitudinal displacement of the locking bar 4, so that by the other cams of the locking bar the slides of either one or more pushbutton switches are released, thus causing them to return to normal in response to the pressure exerted by the reset spring.

According to the invention, the locking bar consists of a metal bar and of locking segments of plastics material connected thereto.

Figures 3, 4, 5, 6, 9:
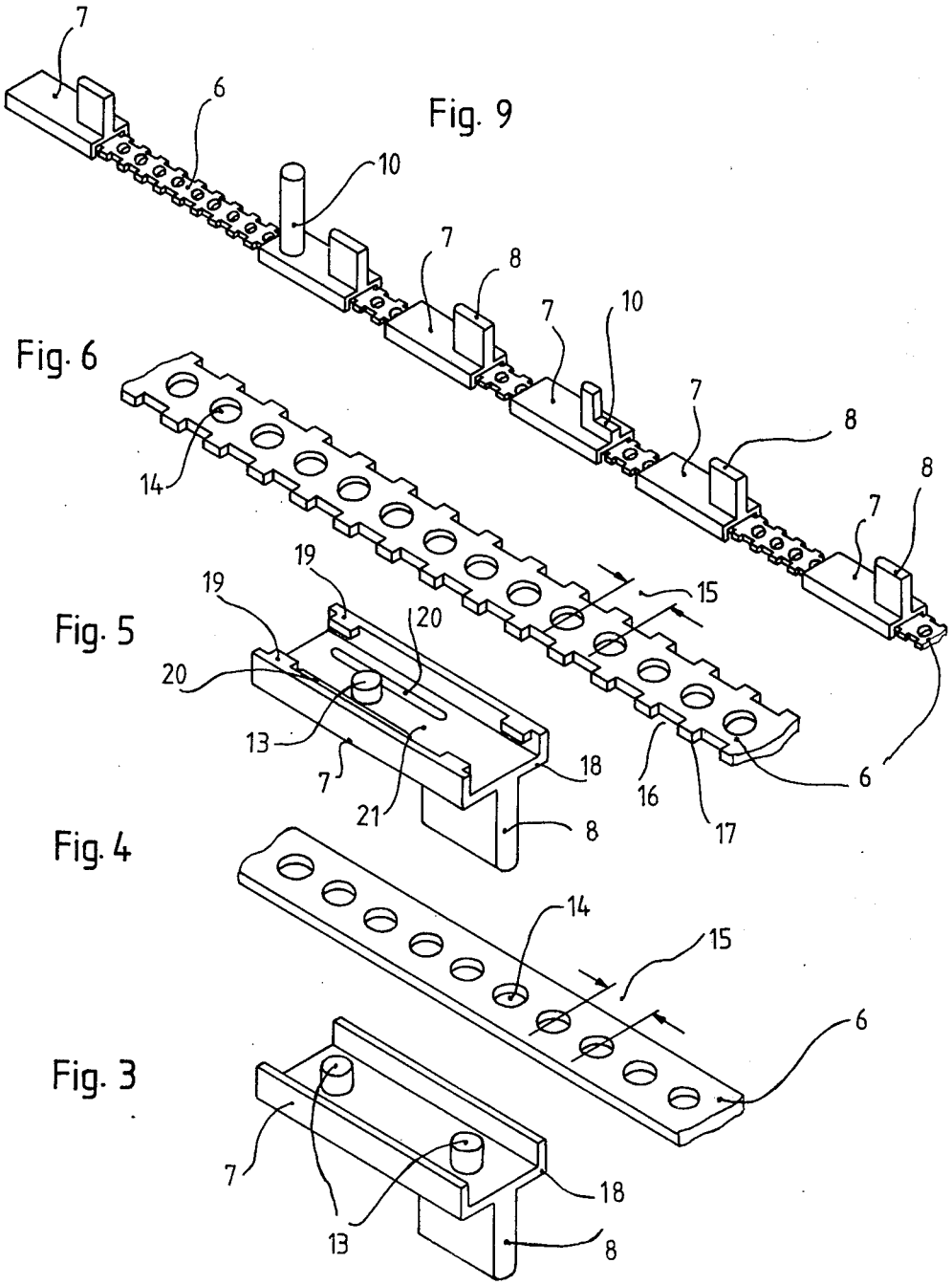
FIGS. 4 and 6 shows the corresponding metal bars.

FIG. 3 shows a suitable locking segment in a perspective representation as seen from below, and FIG. 4 shows the associated metal bar. The locking segment according to FIG. 3 consists of a U-shaped base body 18 which is provided on its bottom side with one or more mounting attachments 13 and, on its top side, with a suitably designed cam 8. With the aid of the mounting attachments 13, the locking segment 7 is mounted to the metal bar 6 as shown in FIG. 4, i.e. in such a way that the base body 18 is placed on to the bar 6, with the mounting attachments 13 engaging into corresponding recesses or holes 14 provided for in the bar 6. The U-shaped design of the base body 18 effects an improved holding on the bar 6 and an exact alignment along the rim portions of the bar. The side members of the base body project over the metal bar, so that the locking bar inside the U-shaped bar, slides on the side members of the locking segments, thus resulting in an easy and low-noise motion. The parts of the mounting attachments 13 as protruding through the holes 14 can be softened and flattened with the aid of a suitable tool, thus resulting in a riveting of the locking segments 7 on the metal bar 6. Preferably, however, both the mounting attachments 13 and the holes 14 are so designed as to result in a snap-action joint, so that the locking segments 7 are retained on the bar 6 in an easily replaceable (detachable) manner.

Instead of the mounting attachments 13 according to FIG. 3, or in addition thereto, also the inside of the U-shaped base body 18 may be provided with suitable attachments, for engaging e.g. into the marginal cutouts 16 of a metal bar, as are shown in FIG. 6.

Another advantageous type of embodiment of the locking segments is shown perspectively in a view from below, in FIG. 5. Here, the legs of the U-shaped part 18 are provided with teeth 19 which are so shaped and arranged as to fit into the recesses 16 as provided for in the metal bar shown in FIG. 6. By a slight longitudinal displacement, the locking segment is then secured on the metal bar, with the teeth 19 of the locking segment 7, in the assembled state, coming to lie opposite the teeth 17 of the metal bar 6 as shown in FIG. 6.

As a protection against any further longitudinal displacement, there is provided a mounting attachment 13 engaging into a corresponding hole provided for in the metal bar 6 as shown in FIG. 6.

In order to facilitate the placement of the locking segment 7, with the mounting attachment 13 still being staggered with respect to the holes and provided for in the metal bar 6, the U-shaped base body is provided with two longitudinal slots 20, thus resulting in a center strip 21 on which the mounting attachment 13 is arranged, and which, as can be easily seen, is connected at its ends to the remaining parts of the locking segment 7. This attachment, after the locking segment 7 has been placed on the bar 6, is bent upwardly and, following the longitudinal displacement of the locking segment 7, the attachment 13 which is under the tension of the extended strip 21, engages into the corresponding hole 14 as provided for in the bar 6.

Figure 7:
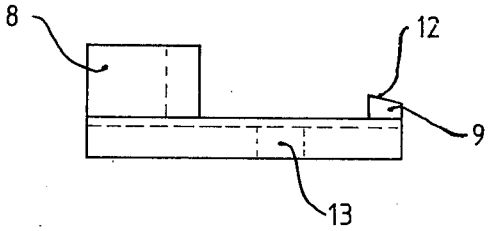
FIGS. 7 and 8 show the front and top views of an individual locking segment according to the invention respectively, and FIG. 9, in a perspective representation, shows one assembled locking bar according to the invention.
Figure 8:
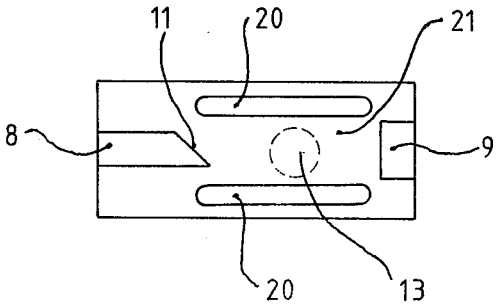

FIGS. 7 and 8 show a front and top view respectively, of a locking segment according to the invention, on which two cams 8 and 9 are provided, each having correspondingly designed slanting run-up surfaces 11 and 12. FIG. 8 very distinctly shows the arrangement of the two slots 20 forming the center strip 21 with the mounting attachment 13 arranged thereon. FIG. 9, in a perspective representation, shows a metal bar 6 with the locking segments 7 placed thereon. These locking segments, as shown, may be arranged at any suitable spaced relation on the bar, but may be arranged just as well quite closely to one another so as to meet against each other. The locking segments may be provided with cams of different type, serving different functions when actuated. The reference numeral 10 indicates a cam form differing from that of the previously shown cams 8. Such types of cams can be used, for example, for actuating an additional switch, such as a muting switch arranged at any suitable point and which, in the manner actually known per se, serves to interrupt certain switch circuits during the switching process, so as to prevent clicking noise. These cams, however, may also be used for effecting an alternate switching over of two pusbutton switches arranged at any suitable point.

We claim:

1. A pushbutton switch assembly in which a plurality of switches are mounted parallel to one another on a U-shaped mounting bar the legs of which extend perpendicular to the axes of the switches and wherein a locking device is mounted for longitudinal movement in said U-shaped mounting bar and is provided with cam surfaces for engaging movable portions of said switches, said assembly comprising:

a longitudinally extending and generally rectangular continuous metallic locking bar slidably mounted in said U-shaped bar for translation therein and said locking bar having a plurality of longitudinally spaced holes therein corresponding to the longitudinal spacing between respective ones of said switches; and, a plurality of plastic locking members respectively mounted in selected ones of said holes of said locking bar, each of said locking members comprising a base portion engaging the upper surface of said locking bar and having a depending attachment portion extending through at least one of said holes in said locking bar to locate the locking member at a fixed position relative to said locking bar, and each of said locking members including a cam portion extending upwardly from said base portion for engaging the movable portion of one of said switches, and wherein said base portion of each of said locking members is U-shaped and wherein the legs of said locking members extend downwardly for engaging edge portions of said locking bar.

2. The switch assembly according to claim 1, wherein said locking bar includes a plurality of longitudinally spaced edge cutout portions in registry with said holes and wherein said legs of said locking members include inwardly directed tabs for engaging respective ones of said cutouts in locking relationship therewith.

3. The switch according to claim 2, wherein said base portion of each of said locking members includes a pair of longitudinally extending slots disposed on opposite sides of said depending attachment portion so that said depending attachment portion is yieldable away from said locking bar when said depending attachment portion is longitudinally staggered between successive ones of said holes.

* * * * *